US008823595B2

(12) United States Patent
Wong et al.

(10) Patent No.: US 8,823,595 B2
(45) Date of Patent: Sep. 2, 2014

(54) COMMUNICATION DEVICE AND ANTENNA STRUCTURE THEREIN

(75) Inventors: Kin-Lu Wong, Kaohsiung (TW); Wun-Jian Lin, Kaohsiung (TW)

(73) Assignee: Acer Incorporated, Taipei Hsien (TW)

( * ) Notice: Subject to any disclaimer, the term of this patent is extended or adjusted under 35 U.S.C. 154(b) by 198 days.

(21) Appl. No.: 13/439,191

(22) Filed: Apr. 4, 2012

(65) Prior Publication Data

US 2012/0188135 A1 Jul. 26, 2012

(30) Foreign Application Priority Data

Jan. 16, 2012 (TW) ..... 101101545

(51) Int. Cl.
*H01Q 9/00* (2006.01)

(52) U.S. Cl.
USPC ..... 343/749; 343/702; 343/700 MS

(58) Field of Classification Search
USPC ..... 343/702, 846, 749, 700 MS
See application file for complete search history.

(56) References Cited

U.S. PATENT DOCUMENTS

| | | | | |
|---|---|---|---|---|
| 8,270,914 | B2 * | 9/2012 | Pascolini et al. | 455/90.2 |
| 2011/0136447 | A1 | 6/2011 | Pascolini et al. | |
| 2011/0193762 | A1 | 8/2011 | Choi et al. | |

FOREIGN PATENT DOCUMENTS

| | | |
|---|---|---|
| WO | WO 2011/113472 | 9/2011 |
| WO | WO 2011/159037 | 12/2011 |

OTHER PUBLICATIONS

European Search Report dated May 28, 2013.

* cited by examiner

*Primary Examiner* — Hoang V Nguyen
(74) *Attorney, Agent, or Firm* — McClure, Qualey & Rodack, LLP

(57) ABSTRACT

A communication device including an antenna structure is provided, wherein the antenna structure includes a ground element, an antenna element, and a circuit element group. The ground element has a notch at one of its edges, and a long edge of the notch is at least two times longer than a short edge of the notch. The antenna element includes a metal portion disposed in the notch. Two ends of the metal portion are extended away from each other and are positioned substantially at or around two opposite edges of the notch. One end of the metal portion is coupled to the ground element, and the other end of the metal portion is a feeding terminal of the antenna element. The circuit element group includes at least a capacitive element and an inductive element.

10 Claims, 5 Drawing Sheets

COMMUNICATION DEVICE AND ANTENNA STRUCTURE THEREIN

CROSS REFERENCE TO RELATED APPLICATIONS

This Application claims priority of Taiwan Patent Application No. 101101545 filed on Jan. 16, 2012, the entirety of which is incorporated by reference herein.

BACKGROUND OF THE INVENTION

1. Field of the Invention

The disclosure generally relates to a communication device and an antenna structure therein, and more particularly, relates to a communication device and an antenna structure with a small half-loop antenna element.

2. Description of the Related Art

With recent rapid development in wireless communication technology, the users are demanding a wide variety of mobile communication devices. To satisfy the demand for multiple functions, more elements are being incorporated into mobile communication devices having limited space therein. Since the space in mobile communication devices is limited, it is required that an antenna designer consider the performances of the antenna therein and the close integration of the antenna with nearby electronic elements in the device as well.

In order to solve the foregoing problems, there is a need to provide a mobile communication device and a small antenna structure therein. The size of the antenna structure should be smaller than one-quarter wavelength (¼λ) corresponding to a frequency in the operating band, and the antenna structure should provide good antenna performance as well.

BRIEF SUMMARY OF THE INVENTION

The invention is aimed to provide a communication device and a small antenna structure therein. The communication device includes a half-loop antenna element, wherein the length of the half-loop antenna element is smaller than one-quarter wavelength of a frequency in the operating band so as to minimize the antenna structure.

In one exemplary embodiment, a communication device comprising a small antenna structure is disclosed. The antenna structure comprises: a ground element, one edge of the ground element having a notch, and a long edge of the notch being at least two times longer than a short edge of the notch; an antenna element comprising a metal portion disposed in the notch, two ends of the metal portion extending away from each other and being positioned substantially at or around two opposite edges of the notch, one of the two ends of the metal portion coupled to the ground element, and the other of the two ends of the metal portion being a feeding terminal of the antenna element; and a circuit element group comprising at least a capacitive element and an inductive element, the capacitive element and the inductive element connected in series and coupled to the feeding element, the circuit element group causing generation of a first resonant mode in a first operating band of the antenna element, and a length of the metal portion being less than 0.18wavelength of the lowest frequency in the first operating band of the antenna element.

In another embodiment, the disclosure is directed to an antenna structure comprising: a ground element, one edge of the ground element having a notch, and a long edge of the notch being at least two times longer than a short edge of the notch; an antenna element comprising a metal portion disposed in the notch, two ends of the metal portion extending away from each other and being positioned substantially at or around two opposite edges of the notch, one of the two ends of the metal portion coupled to the ground element, and the other of the two ends of the metal portion being a feeding terminal of the antenna element; and a circuit element group comprising at least a capacitive element and an inductive element, the capacitive element and the inductive element connected in series and coupled to the feeding element, the circuit element group causing generation of a first resonant mode in a first operating band of the antenna element, and a length of the metal portion being less than 0.18 wavelength of the lowest frequency in the first operating band of the antenna element.

In an embodiment of the invention, the length of the antenna element is only about 45 mm, wherein two ends of the antenna element extend away from each other. A ground element and the corresponding edge of the antenna element form a current path that is similar to a loop antenna. This makes the length of the antenna element become much smaller than the resonant length of a traditional loop antenna with its two ends close to each other. With respect to the antenna element of the invention, a 900-MHz band is excited by an additional capacitive element, and an 1800-MHz band is excited by an additional inductive element. Also, the additional inductive element is configured to adjust the impedance matching of the 900-MHz band. In other embodiments, a matching circuit may be incorporated to adjust the impedance matching of the two bands. The invention can be implemented by printing or etching to be formed on a dielectric substrate. The fabrication process is simple and low-cost.

In an embodiment of the invention, the antenna element is a simple structure made of a metal line, and the length of the antenna element is only about 45 mm. The antenna element can cover at least GSM900/1800 bands (880 MHz~960 MHz/1710 MHz~1880 MHz). By appropriately adjusting the capacitive element, the inductive element and the matching circuit, the antenna element can also cover the GSM850/1900 bands (824 MHz~894 MHz/1850 MHz~1990 MHz). The invention has an advantage of having a small antenna structure. The length of the antenna element made of a metal line is smaller than 0.18 wavelength of the lowest frequency in the first operating band of the antenna element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are shown in detail as follows.

Figure 1:
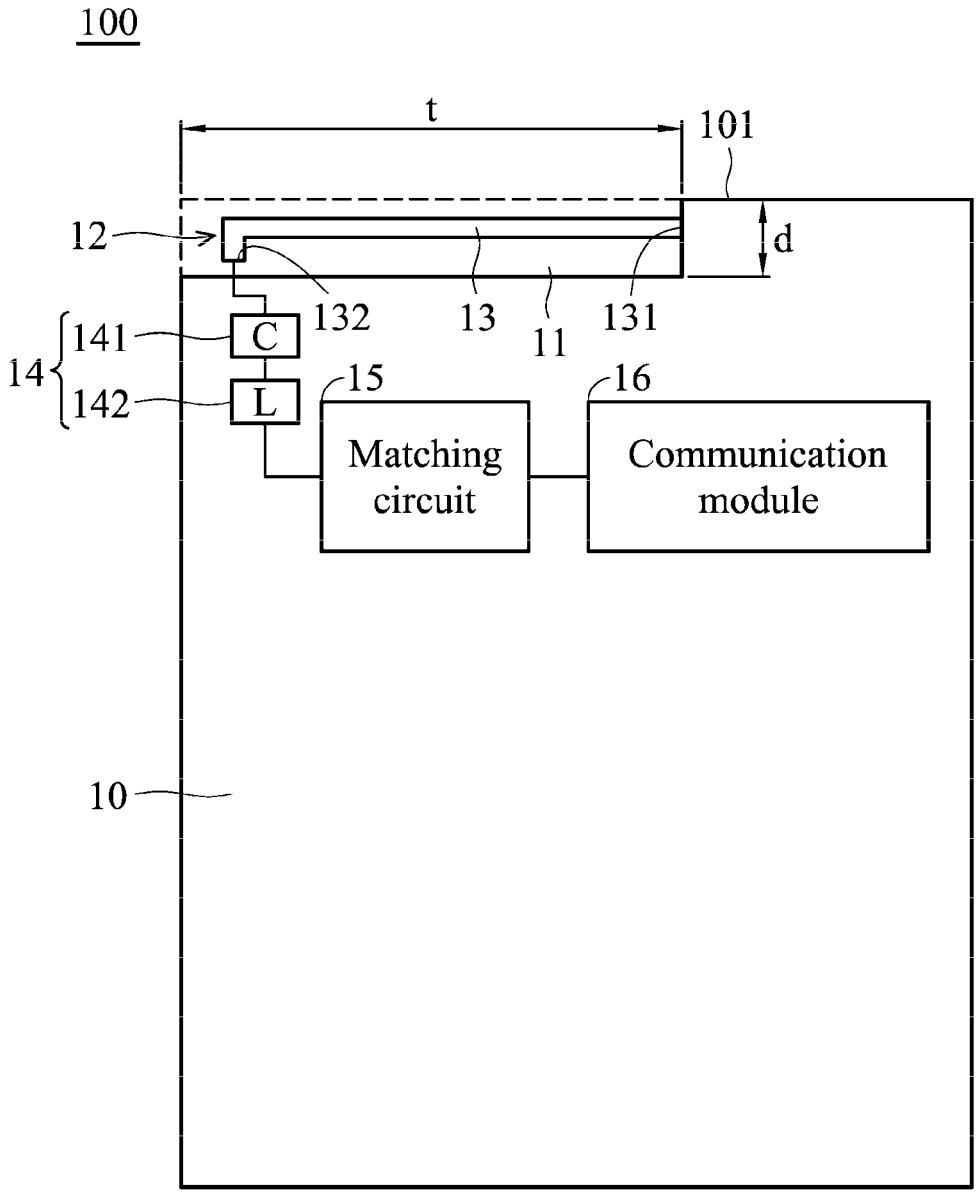
FIG. 1 is a diagram for illustrating a communication device and an antenna structure therein according to a first embodiment of the invention.

FIG. 1 is a diagram for illustrating a communication device 100 and an antenna structure therein according to a first embodiment of the invention. The communication device 100 comprises an antenna structure. The antenna structure comprises a ground element 10, an antenna element 12, and a circuit element group 14. An edge 101 of the ground element 10 has a notch 11, wherein a long edge t of the notch 11 is at least two times longer than a short edge d of the notch 11. The antenna element 12 comprises a metal portion 13 disposed in the notch 11. Two ends 131 and 132 of the metal portion 13 extend away from each other and are positioned substantially at or around two opposite edges of the notch 11, wherein the end 131 is electrically coupled to the ground element 10, and the other end 132 is a feeding terminal of the antenna element 12. The circuit element group 14 comprises at least a capacitive element 141 and an inductive element 142. The capacitive element 141 and the inductive element 142 are connected in series and electrically coupled to the feeding terminal In a preferred embodiment of the invention, the capacitive element 141 may be a chip capacitor, and the inductive element 142 may be a chip inductor. The circuit element group 14 causes the antenna element 12 to generate a first resonant mode in a first operating band of the antenna element 12. A length of the metal portion 13 is less than 0.18 wavelength of the lowest frequency in the first operating band of the antenna element 12. In an embodiment, the communication device 100 and the antenna structure therein further comprise a matching circuit 15 and a communication module 16, wherein the matching circuit 15 is electrically coupled between the circuit element group 14 and the communication module 16 so as to adjust the impedance matching.

Figure 2:
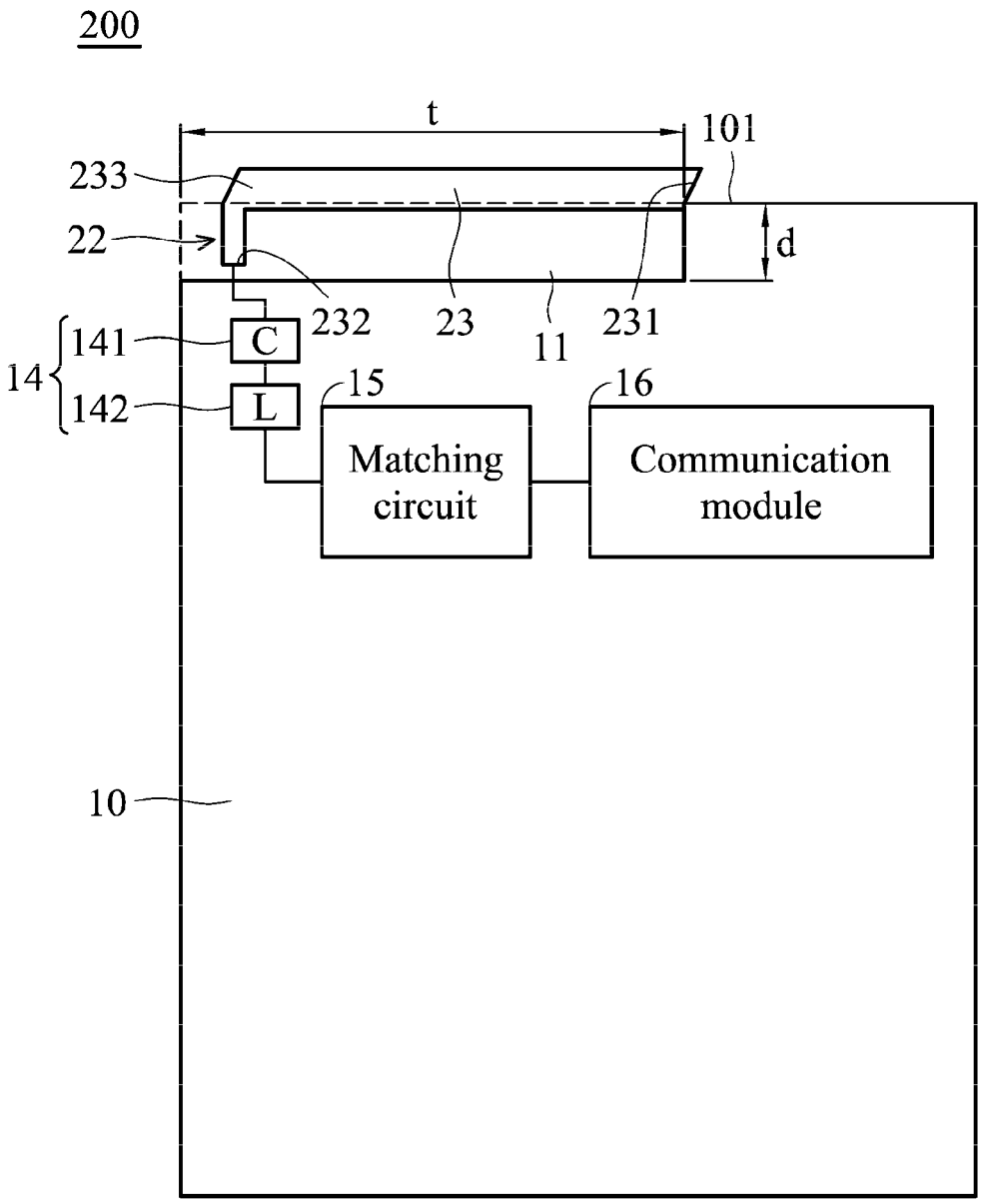
FIG. 2 is a diagram for illustrating a communication device and an antenna structure therein according to a second embodiment of the invention.

FIG. 2 is a diagram for illustrating a communication device 200 and an antenna structure therein according to a second embodiment of the invention. In the second embodiment, a metal portion 23 of an antenna element 22 of the communication device 200 has two ends 231 and 232, wherein the end 231 is electrically coupled to the ground element 10, and the other end 232 is a feeding terminal of the antenna element 22. A part 233 of the metal portion 23 is disposed on a plane which is different from and substantially perpendicular to another plane, on which the notch 11 is positioned. The part 233 of the metal portion 23 makes a current flowing through the half-loop antenna element become smooth so as to increase the bandwidth. The other elements of the communication device 200 and the antenna structure therein are similar to those of the communication device 100 and the antenna structure therein in the first embodiment. In the second embodiment, the ground element 10 is approximately 120 mm in length and 60 mm in width, the antenna element 12 is approximately 45 mm in length, the long edge t of the notch 11 is approximately 40 mm in length, and the short edge d of the notch 11 is approximately 6 mm in length.

Figure 3:
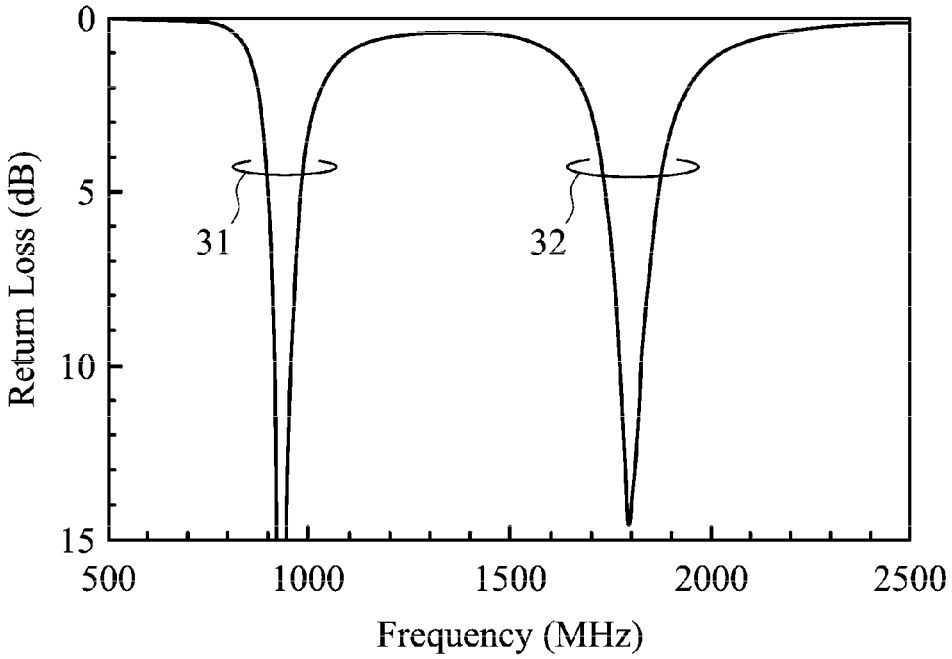
FIG. 3 is a diagram for illustrating return loss of the communication device and the antenna structure therein according to the second embodiment of the invention.

FIG. 3 is a diagram for illustrating return loss of the communication device 200 and the antenna structure therein according to the second embodiment of the invention, wherein the vertical axis represents the return loss (unit: dB), and the horizontal axis represents operating frequency (unit: MHz). The resonant mode in the first operating band 31 of the antenna element 12 is generated by an additional capacitive element 141 (e.g., a chip capacitor), and the resonant mode in the second operating band 32 of the antenna element 12 is generated by an additional inductive element 142 (e.g., a chip inductor). If an appropriate capacitance and an appropriate inductance are selected, the antenna structure in the second embodiment can cover at least GSM900/1800 bands (880 MHz~960 MHz/1710 MHz~1880 MHz). Also, if the capacitive element 141, the inductive element 142 and the matching circuit 15 are selected appropriately in other ways, the antenna structure can cover the GSM850/1900 bands (824 MHz~894 MHz/1850 MHz~1990 MHz), and the dimensions of the metal portion 23 of the antenna element 22 do not have to be changed. Therefore, when different desired bands are adjusted in the invention, it is just required to change the impedance of the circuit element group 14 so as to adjust the resonant mode generated by the capacitive element 141 and the inductive element 142 to cover the desired bands. In other embodiments of the invention, a switching circuit may be incorporated so as to select a part of necessary elements in the circuit element group 14, or an integrated passive device (IPD) may be configured to adjust the impedance matching. It is not necessary to change the dimensions of the antenna element 12.

Figure 4:
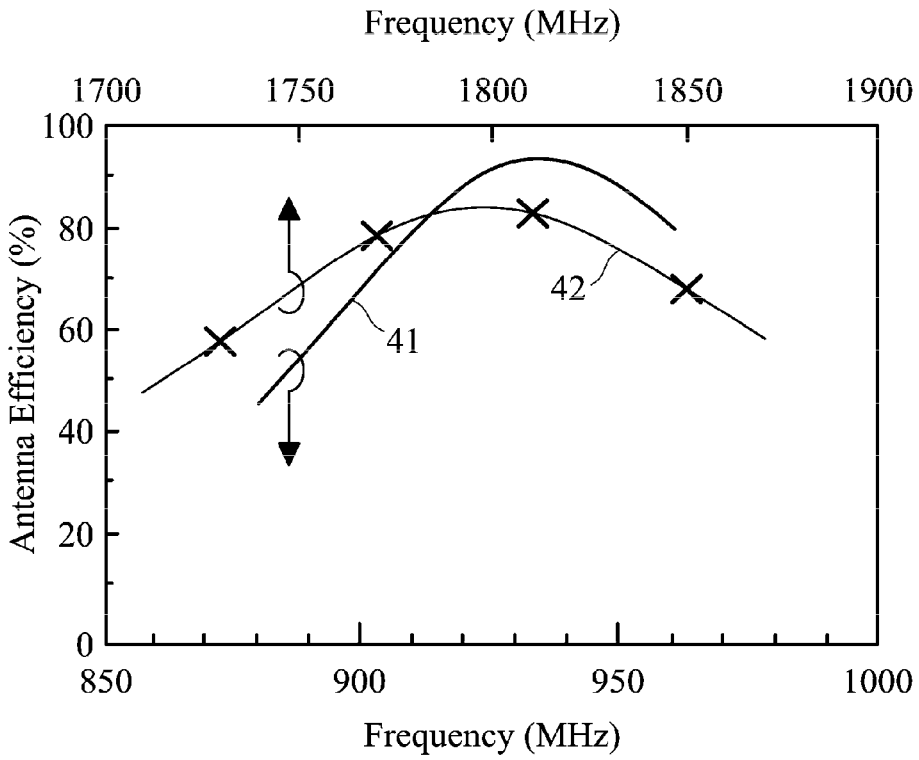
FIG. 4 is a diagram for illustrating antenna efficiency of the communication device and the antenna structure therein according to the second embodiment of the invention.

FIG. 4 is a diagram for illustrating antenna efficiency of the communication device 200 and the antenna structure therein according to the second embodiment of the invention, wherein the vertical axis represents the antenna efficiency (%), and two horizontal axes represent an operating frequency (unit: MHz). The antenna efficiency curve 41 corresponds to the lower horizontal axis, and the antenna efficiency curve 42 corresponds to the upper horizontal axis. The antenna efficiency curve 41 represents antenna efficiency of the antenna structure in a GSM900 band (880 MHz~960 MHz), and the antenna efficiency curve 42 represents antenna efficiency of the antenna structure in a GSM1800 band (1710 MHz~1880 MHz). The communication device and the antenna structure of the invention have good antenna efficiency (the return loss included in the antenna efficiency) in the GSM900 and GSM1800 bands to meet practical applications.

Figure 5:
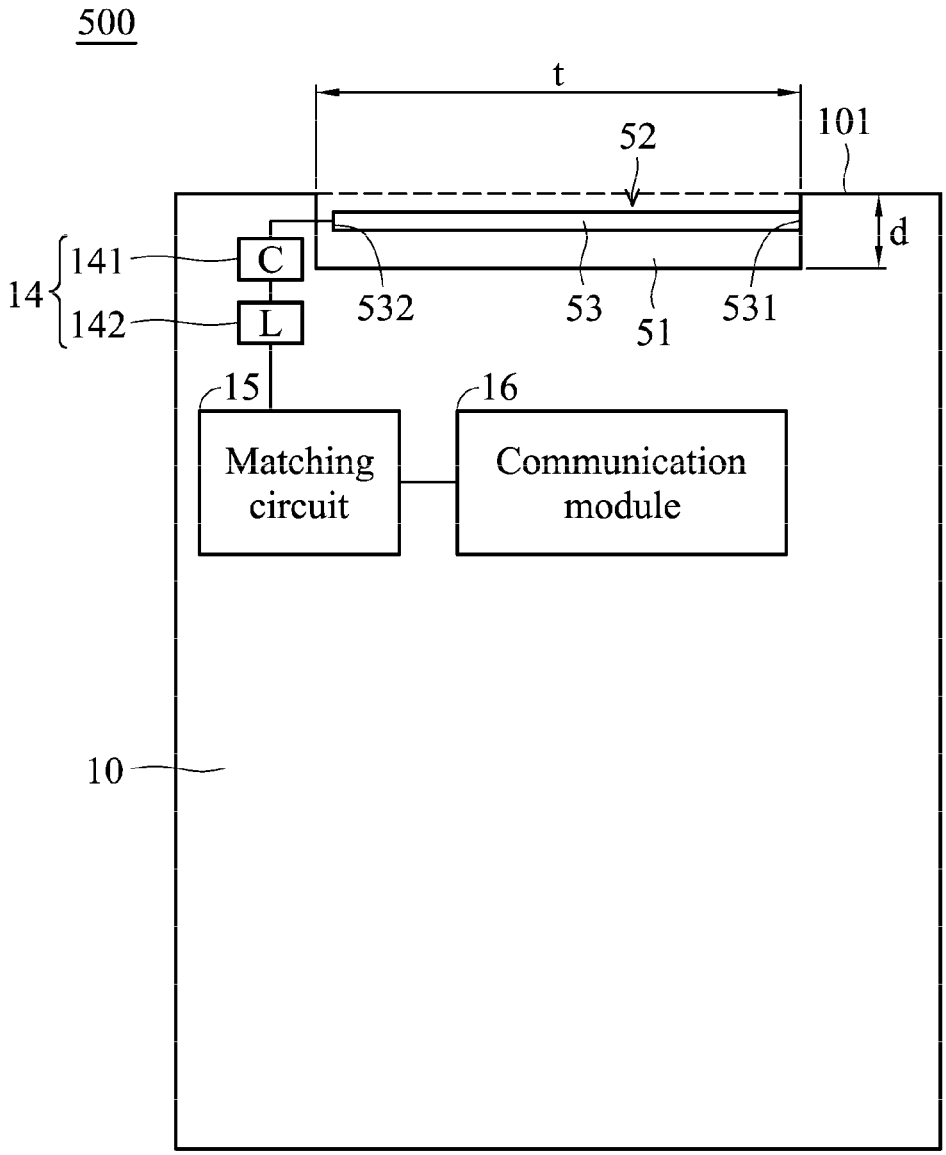
FIG. 5 is a diagram for illustrating a communication device and an antenna structure therein according to a third embodiment of the invention.

FIG. 5 is a diagram for illustrating a communication device 500 and an antenna structure therein according to a third embodiment of the invention. In the third embodiment, a notch 51 of the communication device 500 is positioned substantially at the middle of the ground element 10, and a metal portion 53 of an antenna element 52 is disposed in the notch 51. One end 531 of the metal portion 53 is electrically coupled to the ground element 10, and the other end 532 of the metal portion 53 is electrically coupled to a feeding terminal The other elements of the communication device 500 and the antenna structure therein are similar to those of the communication device 100 and the antenna structure therein in the first embodiment. It is noted that the invention is different from traditional monopole antennas or inverted-F antennas. Since the antenna element 52 does not have any open end, the invention can be adapted to different ground elements easily.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device comprising an antenna structure, the antenna structure comprising:

a ground element, one edge of the ground element having a notch, and a long edge of the notch being at least two times longer than a short edge of the notch;

an antenna element comprising a metal portion disposed at the notch, two ends of the metal portion extending away from each other and being positioned substantially at or around two opposite edges of the notch, one of the two ends of the metal portion coupled to the ground element, and the other of the two ends of the metal portion being a feeding terminal of the antenna element; and a circuit element group comprising at least a capacitive element and an inductive element, the capacitive element and the inductive element arranged in series and coupled to the feeding terminal, the circuit element group causing generation of a first resonant mode in a first operating band of the antenna element, and a length of the metal portion being less than 0.18 wavelength of a lowest frequency in the first operating band of the antenna element.

2. The communication device as claimed in claim 1, wherein the antenna element is further configured to generate a second resonant mode in a second operating band which is higher than the first operating band.

3. The communication device as claimed in claim 1, further comprising a matching circuit coupled between the circuit element group and a communication module.

4. The communication device as claimed in claim 1, wherein a part of the metal portion is disposed on a plane being different from and substantially perpendicular to another plane on which the notch is positioned.

5. The communication device as claimed in claim 1, wherein the capacitive element is a chip capacitor, and the inductive element is a chip inductor.

6. An antenna structure comprising:

a ground element, one edge of the ground element having a notch, and a long edge of the notch being at least two times longer than a short edge of the notch;

an antenna element comprising a metal portion disposed at the notch, two ends of the metal portion extending away from each other and being positioned substantially at or around two opposite edges of the notch, one of the two ends of the metal portion coupled to the ground element, and the other of the two ends of the metal portion being a feeding terminal of the antenna element; and a circuit element group comprising at least a capacitive element and an inductive element, the capacitive element and the inductive element arranged in series and coupled to the feeding terminal, the circuit element group causing generation of a first resonant mode in a first operating band of the antenna element, and a length of the metal portion being less than 0.18 wavelength of a lowest frequency in the first operating band of the antenna element.

7. The antenna structure as claimed in claim 6, wherein the antenna element is further configured to generate a second resonant mode in a second operating band which is higher than the first operating band.

8. The antenna structure as claimed in claim 6, further comprising a matching circuit coupled between the circuit element group and a communication module.

9. The antenna structure as claimed in claim 6, wherein a part of the metal portion is disposed on a plane which is different from and substantially perpendicular to another plane on which the notch is positioned.

10. The antenna structure as claimed in claim 6, wherein the capacitive element is a chip capacitor, and the inductive element is a chip inductor.

* * * * *